US009896262B2

(12) United States Patent
Yang et al.

(10) Patent No.: US 9,896,262 B2
(45) Date of Patent: Feb. 20, 2018

(54) STORAGE BOX USING CUSHION PACKAGE STRUCTURE

(71) Applicant: AU Optronics Corp., Hsin-Chu (TW)

(72) Inventors: Chih-Kai Yang, Hsin-Chu (TW); Shih-Chi Chen, Hsin-Chu (TW); Chung-Kuan Ting, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 390 days.

(21) Appl. No.: 14/700,156

(22) Filed: Apr. 30, 2015

(65) Prior Publication Data

US 2016/0122111 A1 May 5, 2016

(30) Foreign Application Priority Data

Oct. 30, 2014 (TW) ..... 103137688 A

(51) Int. Cl.
*B65D 85/38* (2006.01)
*B65D 81/113* (2006.01)
*B65D 85/48* (2006.01)

(52) U.S. Cl.
CPC ..... *B65D 85/38* (2013.01); *B65D 81/113* (2013.01); *B65D 85/48* (2013.01)

(58) Field of Classification Search
CPC .... B65D 5/5085; B65D 25/107; B65D 81/05; B65D 81/053; B65D 81/055–81/057; B65D 81/113; B65D 85/48; B65D 2581/051; B65D 2581/055; B65D 2581/058; B65D 2585/6837
USPC ..... 206/521–594; 220/918–920
See application file for complete search history.

(56) References Cited

U.S. PATENT DOCUMENTS 3,701,465 A * 10/1972 Richter ..... B65D 81/056 206/521
5,339,958 A * 8/1994 Taravella ..... B65D 81/05 206/521
5,755,331 A * 5/1998 Watson ..... B65D 81/05 206/586
6,644,476 B2 * 11/2003 Wu ..... B65D 81/05 206/586
7,946,426 B2 * 5/2011 Ohsawa ..... B65D 81/053 206/586
2008/0099369 A1 * 5/2008 Ting ..... B65D 5/5085 206/591

(Continued)

*Primary Examiner* — Chun Cheung
*Assistant Examiner* — Brijesh V. Patel
(74) *Attorney, Agent, or Firm* — Locke Lord LLP; Tim Tingkang Xia, Esq.

(57) ABSTRACT

A cushion package structure includes at least a plate and two or more blocks. The plate is disposed within a storage box and the blocks are the same and pivotable with one another. As a number of blocks are connected with one another serially with various including angle between each adjacent two, one or multiple block sets may be formed thereby. Positioning holes on the plate having substantially same contour as corresponding positioning sections on the blocks are further prepared to engage with the positioning sections as the block sets are put to be disposed on the plate, thereby forming a storage space with a specific shape within the storage box. The blocks may be removed from the plate, rearranged, and redisposed on another plate, so that a storage space with a different shape may be defined.

18 Claims, 17 Drawing Sheets

(56) References Cited

U.S. PATENT DOCUMENTS

| | | | | |
|---|---|---|---|---|
| 2008/0149519 | A1* | 6/2008 | Ting | B65D 81/05<br>206/521 |
| 2012/0241351 | A1* | 9/2012 | Tsukii | B65D 81/113<br>206/521 |

* cited by examiner

STORAGE BOX USING CUSHION PACKAGE STRUCTURE

BACKGROUND OF THE INVENTION

1. Field of the Invention

The invention relates to a package structure, and more particularly, to a cushion package structure for an LCD panel or a glass substrate.

2. Description of the Prior Art

LCD panels or glass substrates are commonly divided into piles and put into customized storage boxes for storage and protection during transportation. To prevent these components from cracking or damaging caused by the storage boxes accidentally falling, vibrating, or being squeezed when transported or stored, foaming material is commonly used as an internal cushion.

However, with the uniqueness of each panel or substrate, each storage box should be tailored to have a corresponding internal room for properly and securely accommodating these panels or substrates. In other words, storage boxes for panels or substrates of one type are not going to accommodate panels or substrates of another type.

Although some storage boxes with larger internal room can be remodeled to have smaller internal room by attaching additional foaming material to the internal walls, so as to accommodate panels or substrates of smaller size, additional procedure of remodeling is required and attaching the foaming material to the internal walls of the storage boxes is so limited that it can only be done once for each storage box. Reuse of such remodeled storage boxes is not a practical solution. Furthermore, the foaming material to attach to the internal walls for remodeling requires additional work to be processed into blocks with customized size and shape, which extensively brings limitation to the applicability of conventional storage boxes and blocks.

SUMMARY OF THE INVENTION

To solve the above problem, the invention provides a cushion package structure for more efficient usability of a storage box.

In an embodiment of the invention, a cushion package structure is provided to be disposed within a storage box. The storage box includes a first cover and a second cover, and between the first cover and the second cover a containing room is defined and surrounded by a plurality of sidewalls. The cushion package structure is disposed in the containing room so as to provide a storage room in the storage box. The cushion package structure includes a top plate, and at least two blocks. The top plate includes at least a top positioning hole. The top plate is disposed at a top surface of the first cover and the top surface is surrounded and defined by the plurality of sidewalls. Each block includes sequentially a left section, a middle section, and a right section adjacent to one another. The right section of one block is pivoted to the left section of the adjacent another block. The middle section of each block includes atop groove. A positioning section is formed between the top groove of one block and the top groove of the adjacent another block. The positioning section is coupled with the top positioning hole, so that the two blocks are coupled with the top plate. The two blocks are pivoted to each other and coupled with the top plate. One block has a flat abutting plane at a side and the flat abutting plane is adjacent to at least a boundary of the storage room.

The cushion package structure of the embodiment is further provided that the left section includes a left pivot part having a pin and the right section includes a right pivot part having a pin hole. The pin hole of the right section of one block is coupled and pivoted to the pin of the left section of another block, so that the two blocks are pivotable with each other. The thickness of the left pivot part and the right pivot part along a coupling direction is half the maximum thickness of the middle section.

The cushion package structure of the embodiment is further provided that the two blocks are pivoted to each other with an included angle therebetween. The positioning section has corresponding contour according to the included angle and the top positioning hole surrounds the positioning section and abuts against at least two sides of the positioning section. The at least two sides of the positioning section includes the sides of the two blocks that define the top grooves.

The cushion package structure of the embodiment is further provided that a part between two adjacent top positioning holes of the top plate is coupled and fastened to the top groove of the corresponding block.

The cushion package structure of the embodiment is further provided to include a plurality of blocks pivoted to one another and disposed along at least a sidewall of the storage box. At least three adjacent blocks are pivoted to one another in a U shape. The middle section of the middle block provides the flat abutting plane at another side opposite to the sidewall.

The cushion package structure of the embodiment is further provided that the top plate further includes a support part formed by bending of the top plate. The support part is adjacent to the middle section of the middle block and abuts against the middle section gravitationally upward.

The cushion package structure of the embodiment is further provided that the thickness of the middle section of the middle block that forms the top groove is half the maximum thickness of the middle section. The top groove further includes a pin coupled and pivoted to a pin hole of the right section of another block.

The cushion package structure of the embodiment is further provided that the middle section of at least one block includes a hook and the top plate includes a ring corresponding to the hook. The ring is formed by bending of the top plate and the ring couples with the hook.

The cushion package structure of the embodiment is further provided to include a bottom plate disposed at a bottom surface of the second cover. The bottom surface is surrounded and defined by the plurality of sidewalls. The area and the shape of the bottom plate is substantially the same as that of the bottom surface. The bottom plate includes at least a bottom positioning hole. The middle section of each block includes a bottom groove and the positioning section is formed between the bottom groove of one block and the bottom groove of the adjacent another block. The positioning section is coupled with the bottom positioning hole, so that the two blocks are coupled with the bottom plate.

In another embodiment of the invention, a cushion package structure is provided to be disposed within a storage box. The storage box includes a containing room and the cushion package structure is disposed in the containing room. The cushion package structure includes a plate and at least two blocks. The plate is disposed at a surface of the storage box and the plate includes at least a positioning hole. The two blocks are disposed at the plate. At least one of the blocks defines at least a boundary of a storage room on the plate.

Each block includes sequentially a left section, a middle section, and a right section adjacent to one another. The right section of one block is pivoted to the left section of the adjacent another block. The middle section of each block includes a groove and a positioning section is formed between the groove of one block and the groove of the adjacent another block after the two blocks pivoted to each other. The positioning section is coupled with the positioning hole, so that the two blocks are coupled with the plate.

The cushion package structure of the embodiment is further provided that the left section includes a left pivot part having a pin and the right section comprises a right pivot part having a pin hole. The pin hole of the right section of one block is coupled and pivoted to the pin of the left section of another block, so that the two blocks are pivotable with each other.

The cushion package structure provided in the invention offers flexibility in using the room of a storage box by assembling various blocks and block sets, rendering the included angles between every two adjacent blocks, so that the storage room may be defined and customized. The blocks are removable from the plate and reattached to another plate for use of a different storage room, which substantially reduces idling of the storage boxes.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion.

Figure 1:
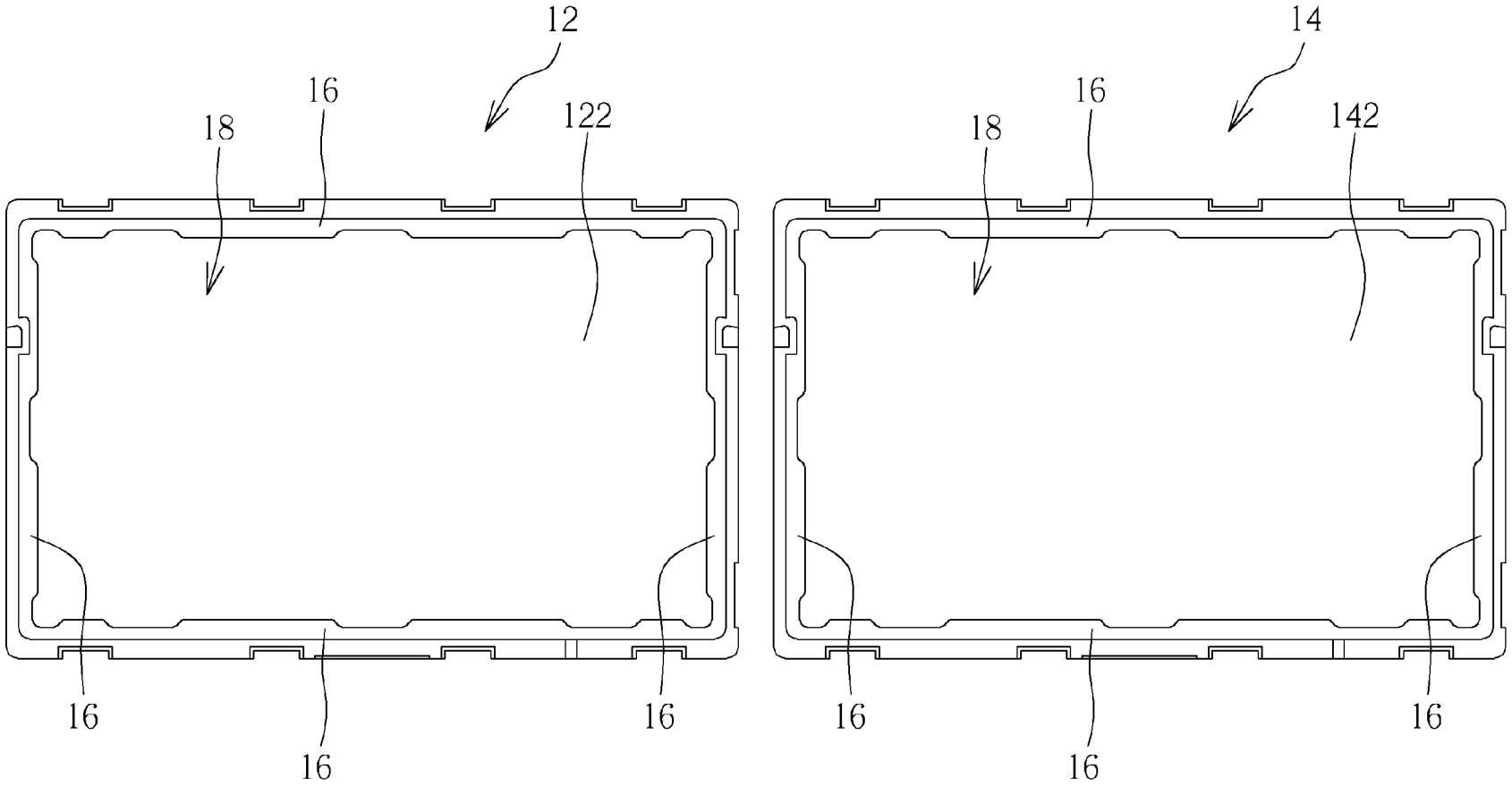
FIG. 1 is an illustration showing a storage box for an LCD panel or a glass substrate.

Please refer to FIG. 1. FIG. 1 is an illustration showing a storage box for an LCD panel or a glass substrate. The storage box 1 is utilized for storing LCD panels or glass substrates, which can be well fastened during transportation or storage. The storage box 1 includes a first cover 12, a second cover 14, and a plurality of sidewalls 16. The sidewalls 16 can be a portion of the first cover 12 or a portion of the second cover 14. The sidewalls 16 can also be partly a portion of the first cover 12 and partly a portion of the second cover 14. Between the first cover 12 and the second cover 14, a containing room 18 is defined and surrounded by the plurality of sidewalls 16. Additionally, a top surface 122 of the first cover 12 is surrounded and defined by the plurality of sidewalls 16 and a bottom surface 142 of the second cover 14 is also surrounded and defined by the plurality of sidewalls 16.

Figure 2A:
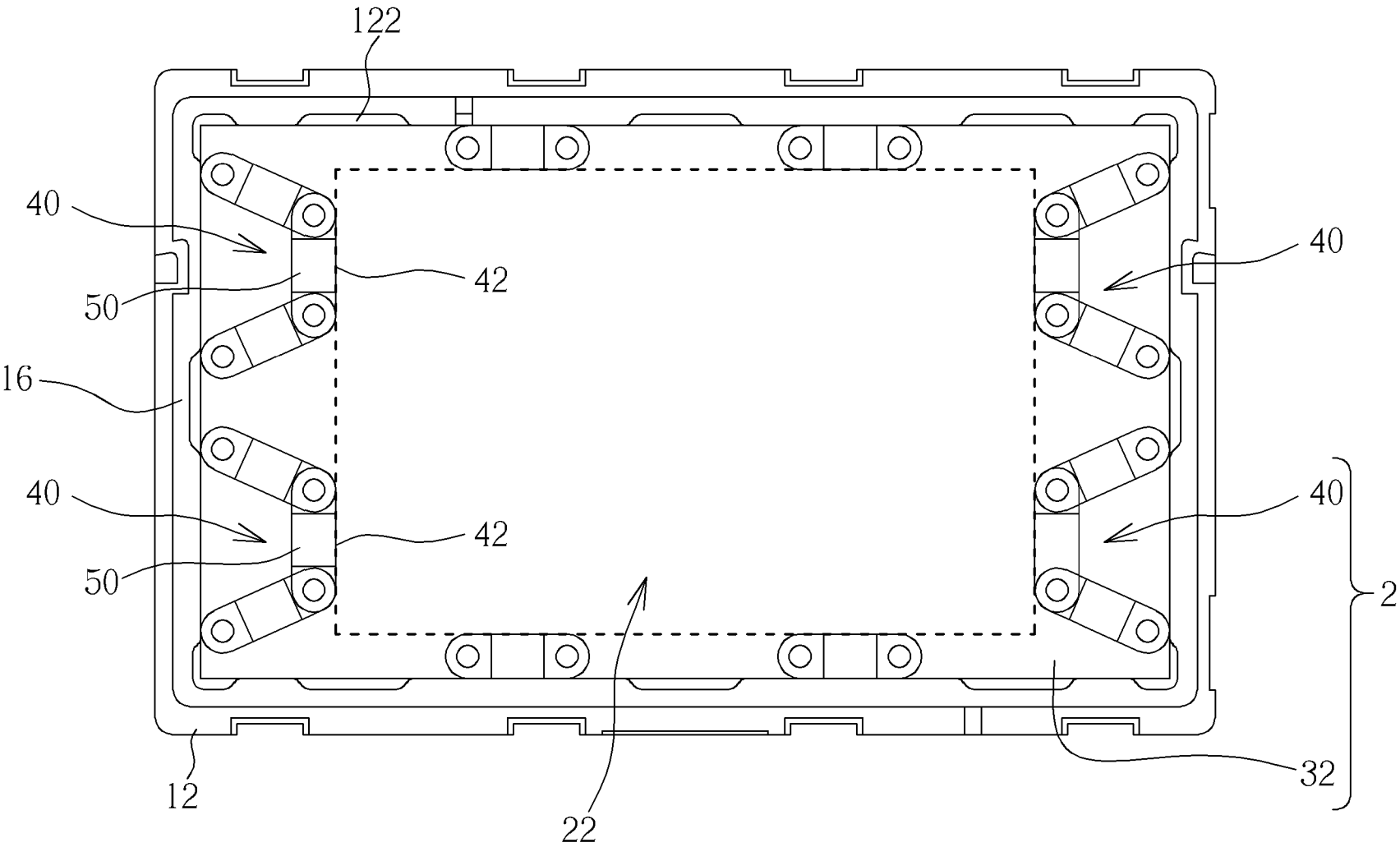
FIGS. 2A, 2B, 2C, and 2D are illustrations showing various embodiments of cushion package structures disposed within the storage box of FIG. 1 according to the invention.
Figure 2B:
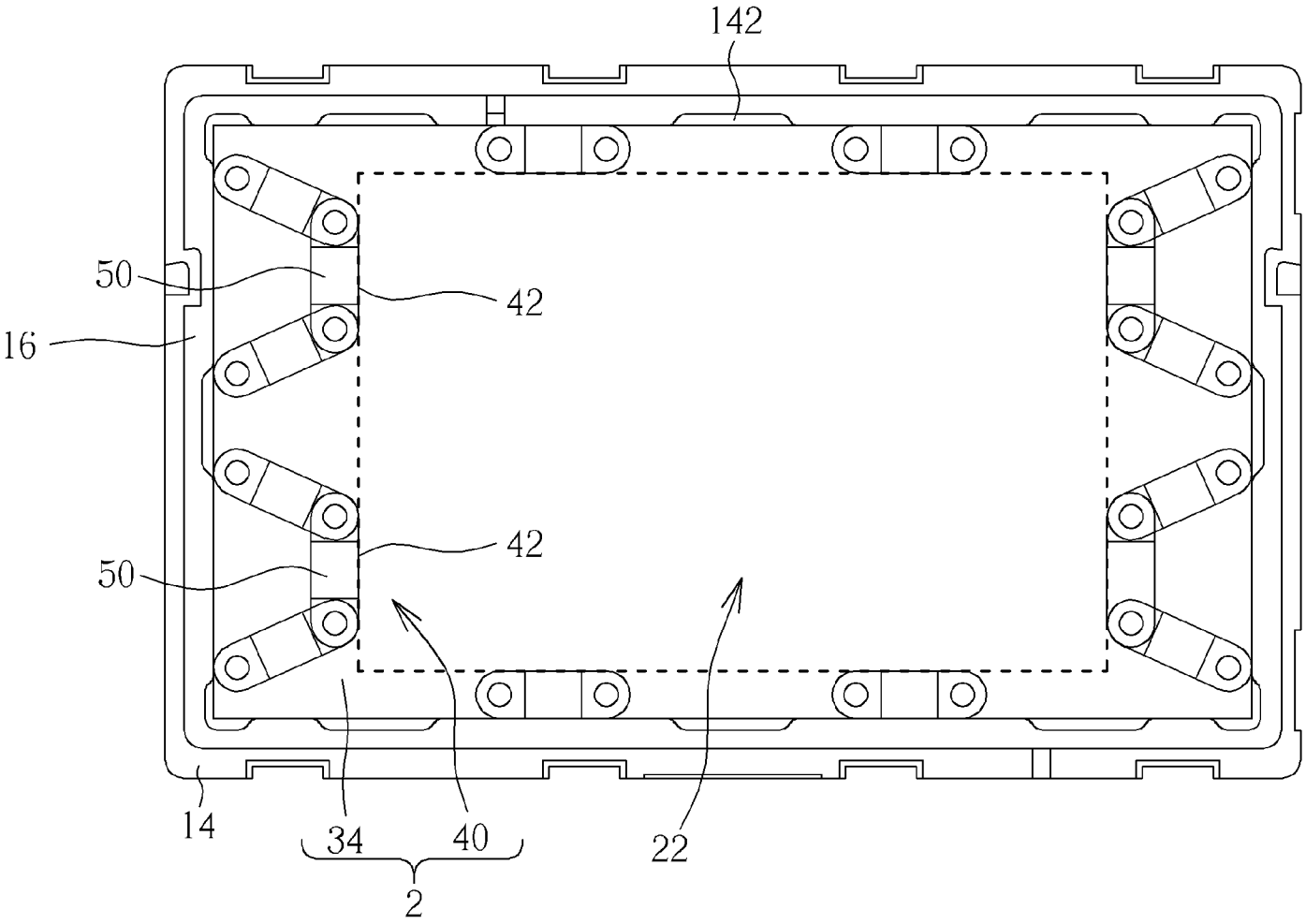
Figure 2C:
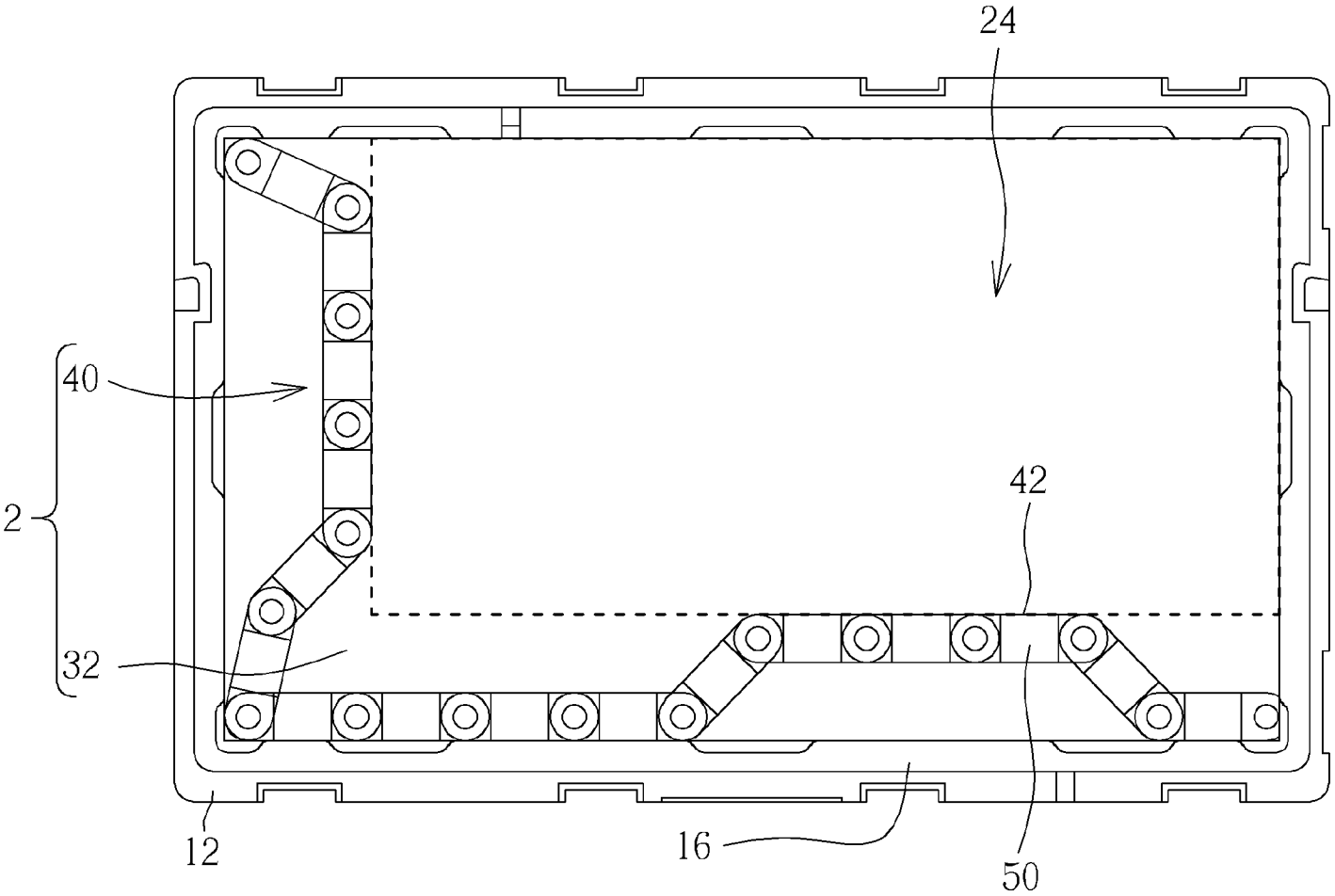

Please refer to FIGS. 2A, 2B, 2C, and 2D, which are illustrations showing various embodiments of cushion package structures disposed within the storage box of FIG. 1 according to the invention. In FIGS. 2A and 2B, a cushion package structure 2 is disposed in the containing room 18 of the storage box 1 as shown in FIG. 1 so as to provide a storage room 22 in the storage box 1. FIG. 2A shows only the cushion package structure 2 disposed in the first cover 12 of the storage box 1. The cushion package structure 2 includes at least a top plate 32 and block sets 40, which in this embodiment multiple block sets 40, composed of at least two or more than two blocks 50. The top plate 32 is disposed at the top surface 122 of the first cover 12 (also referring to FIG. 1) and has substantially the same or slightly smaller area and shape as the top surface 122. More specifically, in FIG. 2A, besides the contour of the top surface 122 being substantially the same as the top plate 32 to accommodate the top plate 32, the top surface 122 also has concaved sections at one or more sides or corners, which enhances the accessibility of the top plate 32 and also prevents interference, collision, or wearing between the corners of the top plate 32 and the storage box 1. In other embodiments, the contour of the top surface 122 can be of the same shape and slightly larger than that of the top plate 32. FIG. 2A shows only the cushion package structure 2 disposed in the second cover 14 of the storage box 1. The cushion package structure 2 also includes a bottom plate 34 disposed at the bottom surface 142 of the second cover 14 and has substantially the same or slightly smaller area and shape as the top surface 142. One or multiple block sets 40 are disposed between the top plate 32 and the bottom plate 34, each including one or multiple blocks 50 and at least one block 50 of the block sets 40 defining at least a boundary of the storage room 22 between the top plate 32 and the bottom plate 34. Preferably, the embodiments of the invention show that the block sets 40 are disposed both at the top plate 32 and the bottom plate 34, so that the storage room 22 may be formed by the cushion package structure 2 in the storage box 1. The cushion package structure 2 shown in FIG. 2A and FIG. 2B provides the storage room 22 with rectangular contour, while the storage room 22 may also be provided with square or polygonal contour. In another embodiment as shown in FIG. 2C, which illustrates only the cushion package structure disposed in the first cover of the storage box, the block sets 40 are disposed along two sidewalls, the left sidewall and the bottom sidewall as referred in the figure. The block sets 40 together with other sidewalls of the storage box 1, the top sidewall and the right sidewall as referred in the figure, define a storage room 24. In still other embodiments, the blocks 50 or block set 40 including multiple blocks 50 may also be disposed along just one sidewall and jointly define the storage room with other sidewalls.

In other embodiments, the blocks 50 or block sets 40 may be so arranged that the storage room formed thereby come with contours like circular shape, oval shape, regular or irregular curved shape. In other words, besides storage for rectangular panels like the embodiments in FIGS. 2A, 2B, and 2C providing storage room for such panels, solutions to store heteromorphic panels can be achieved by the invention using one or multiple planes from the blocks and/or the sidewalls withstanding any surface or side or the rectangular panel or the heteromorphic panel. For example, in another embodiment shown in FIG. 2D, which illustrates only the cushion package structure disposed in the first cover of the storage box, a storage room 26 formed by multiple block sets 40 is capable of accommodating a heteromorphic panel with larger or outreaching corners. Hence, LCD panels or glass substrates with different shapes can be completely or partially stored in the storage rooms of the above embodiments.

Figure 2D:
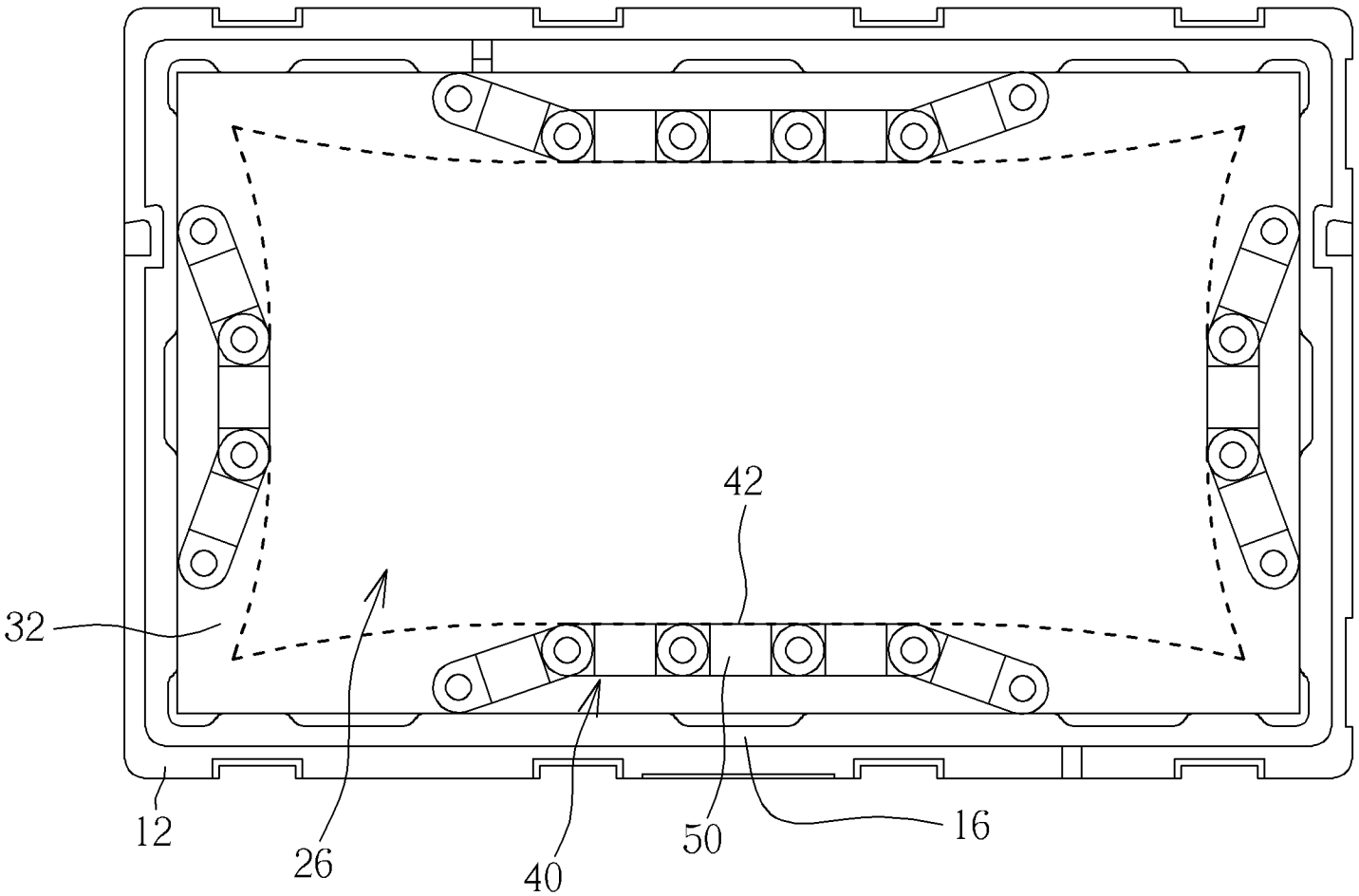

Additionally, the storage box 1 is usually transported or stored in a straight up way. For example, as the storage box is positioned straight up and one or multiple blocks 50 of the block sets 40 are coupled with the top plate 32 and the bottom plate 34 in FIGS. 2A and 2B, at least one from the top plate 32, the bottom plate 34, and the blocks 50 will abut, gravitationally downward, against one sidewall 16, the left sidewall for the embodiments in FIGS. 2A and 2B, and in this embodiment, the top plate 32, the bottom plate 34, and part of the blocks 50 all abut against the sidewall 16. At least one block 50, the one with a labeled flat abutting plane 42 in FIGS. 2A and 2B, has another side opposite to the sidewall 16 defining at least a boundary of the storage room 22 and providing the abutting plane 42. Likewise, FIGS. 2C and 2D shows the gravitationally downward direction toward the bottom of the drawing, where at least one block 50 provides a flat abutting plane 42, and more specifically, the embodiments in FIGS. 2C and 2D have at least three blocks providing a flat and continuous abutting plane 42, offering better stability with larger abutting area. These abutting planes 42 support the LCD panels or glass substrates in the storage rooms 22, 24, 26 during transportation or storage. However, the invention is not limited by these embodiments. In another embodiments, the storage box 1 can also be placed horizontally to store the LCD panels or glass substrates, while the top plate 32, the bottom plate 34, or the block sets 40 does not necessarily have contact with any of the sidewalls 16, and the block sets 40 may also be disposed at any position of the top plate 32 and the bottom plate 34 based on the design of the storage room.

Figure 3:
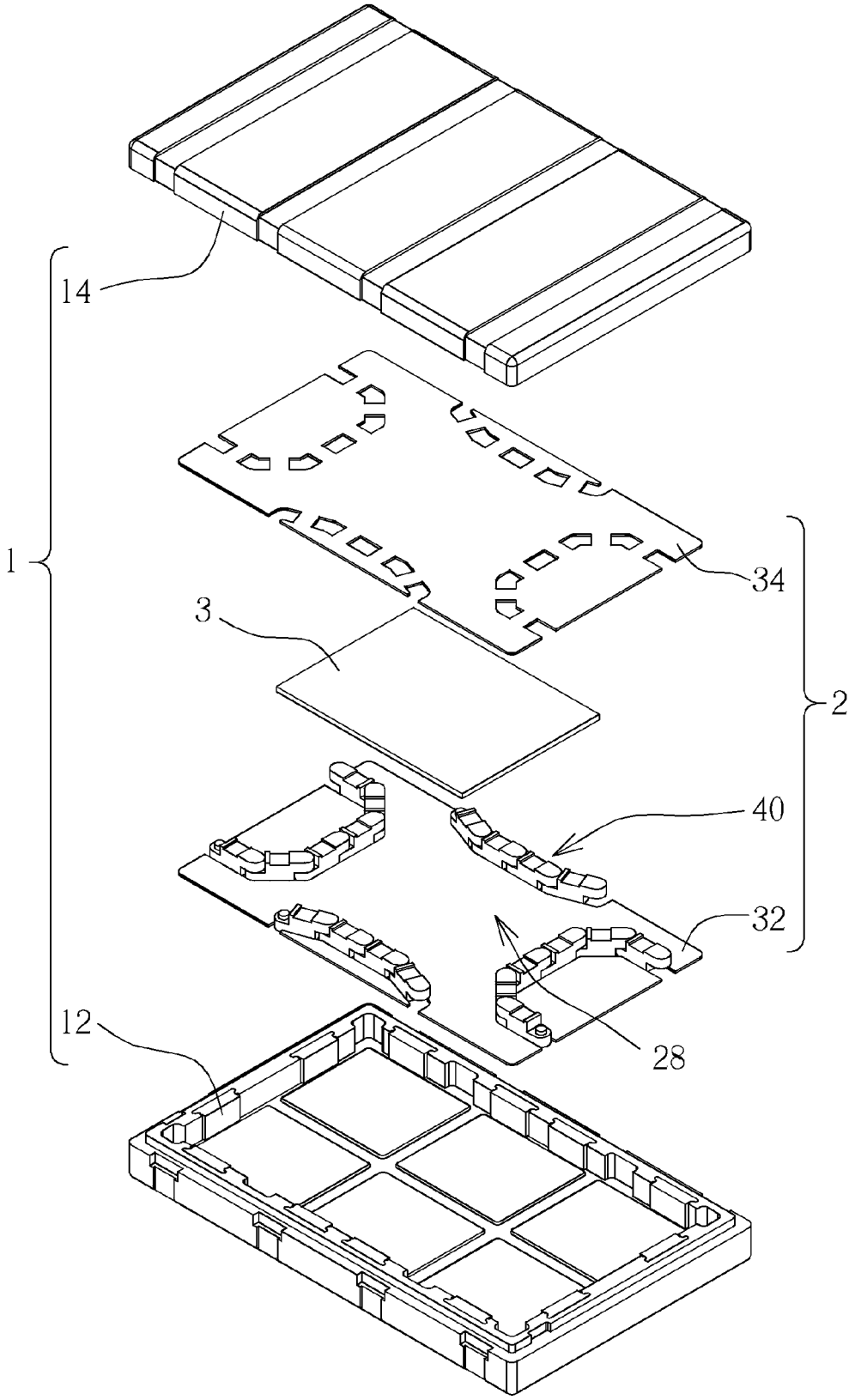
FIG. 3 is an illustration showing an exploded view of the cushion package structure, the storage box, and the LCD panel according to the invention.

Please refer to FIG. 3. FIG. 3 is an illustration showing an exploded view of the cushion package structure, the storage box, and the LCD panel according to the invention. FIG. 3 shows that the first cover 12, the top plate 32, the block sets 40 composed by the blocks 50, an LCD panel 3, the bottom plate 34, and the second cover 14 are positioned in order. The block sets 40 are disposed between the top plate 32 and the bottom plate 34, in which the block sets 40 are illustrated to already in assembly with the top plate 32. The LCD panel 3 is accommodated in the storage room 28 formed by the top plate 32, the bottom plate 34, and the block sets 40.

Figure 4:
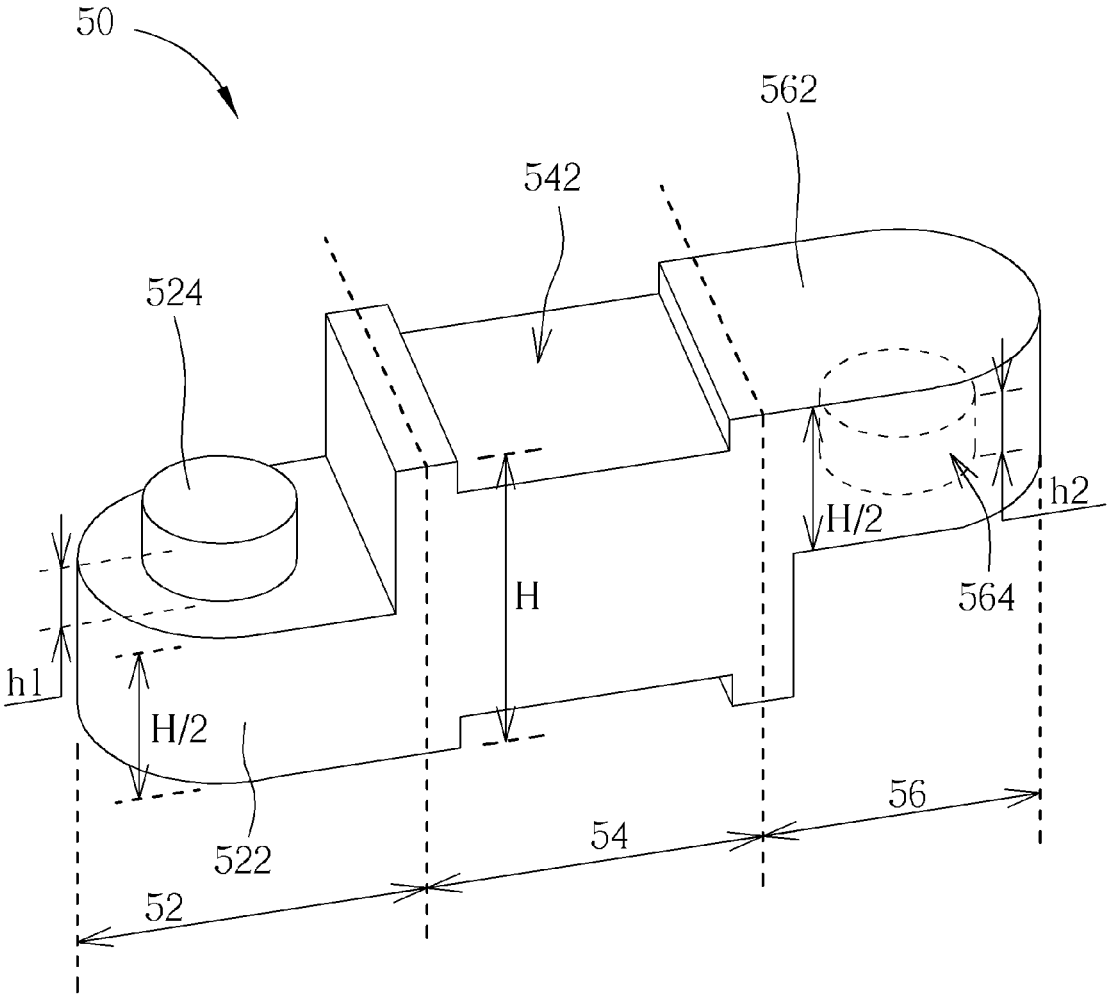
FIG. 4 is an illustration showing an embodiment of a first type of block of the cushion package structure according to the invention.

Please refer to FIG. 4. FIG. 4 is an illustration showing an embodiment of a first type of block of the cushion package structure according to the invention. As previously described, the cushion package structure 2 includes the block sets 40, each including at least a block 50. Preferably, each block 50 in the invention is made of foam materials with foaming density ranging between 0.06 $g/cm^3$~0.03 $g/cm^3$, and each block 50 is made by cutting foam materials and formed monolithically and substantially the same with one another. However, the invention is not limited to such arrangement. In other words, blocks 50 with the same size, of the same type, or even with different type, can be assembled with one another to form block sets 40 that have various configurations, so that the block sets 40 can be coupled with the plates and provide the storage room as required. Specific structure of the block 50 is described in the following paragraphs.

Each block 50 includes sequentially a left section 52, a middle section 54, and a right section 56 adjacent to one another. The left section 52 includes a left pivot part 522 having a pin 524, in the figure the pin 524 extending upward, and the right section 56 includes a right pivot part 562 having a pin hole 564, in the figure the pin hole 564 being a hole extending downward. Each two blocks 50 may be pivoted with each other. More specifically, the pin hole 564 of the right section 56 of one block 50 may be coupled and pivoted to the pin 524 of the left section 52 of another block 50, so that the two blocks 50 may be pivotable with each other. The maximum thickness of the middle section 54 of each block 50 is H, while the thickness of the left pivot part 522 and the right pivot part 562 along a coupling direction is half the maximum thickness H, I.e., H/2. Hence, as multiple blocks 50 are pivoted with one another, the block set 40 formed thereby has substantially even thickness. It should be noted that, besides the above feature, the height h1 of the pin 524 at the left pivot part 522 of each block 50 is shorter than or equal to the depth h2 of the pin hole 564 at the right pivot part 562, so that the bock set 40 formed by each block 50 can have substantially even thickness. In this embodiment, the depth h2 of the pin hole 564 is no more than H/4, such that the depth h2 of the pin hole 564 of each block 50 is capable of accommodating the pin 524 of another block 50 after assembling of the two blocks 50, so that the multiple blocks 50 that pivoted with one another may not introduce uneven thickness caused by the pin 524 longer than the depth of the pin hole 564.

Figure 5:
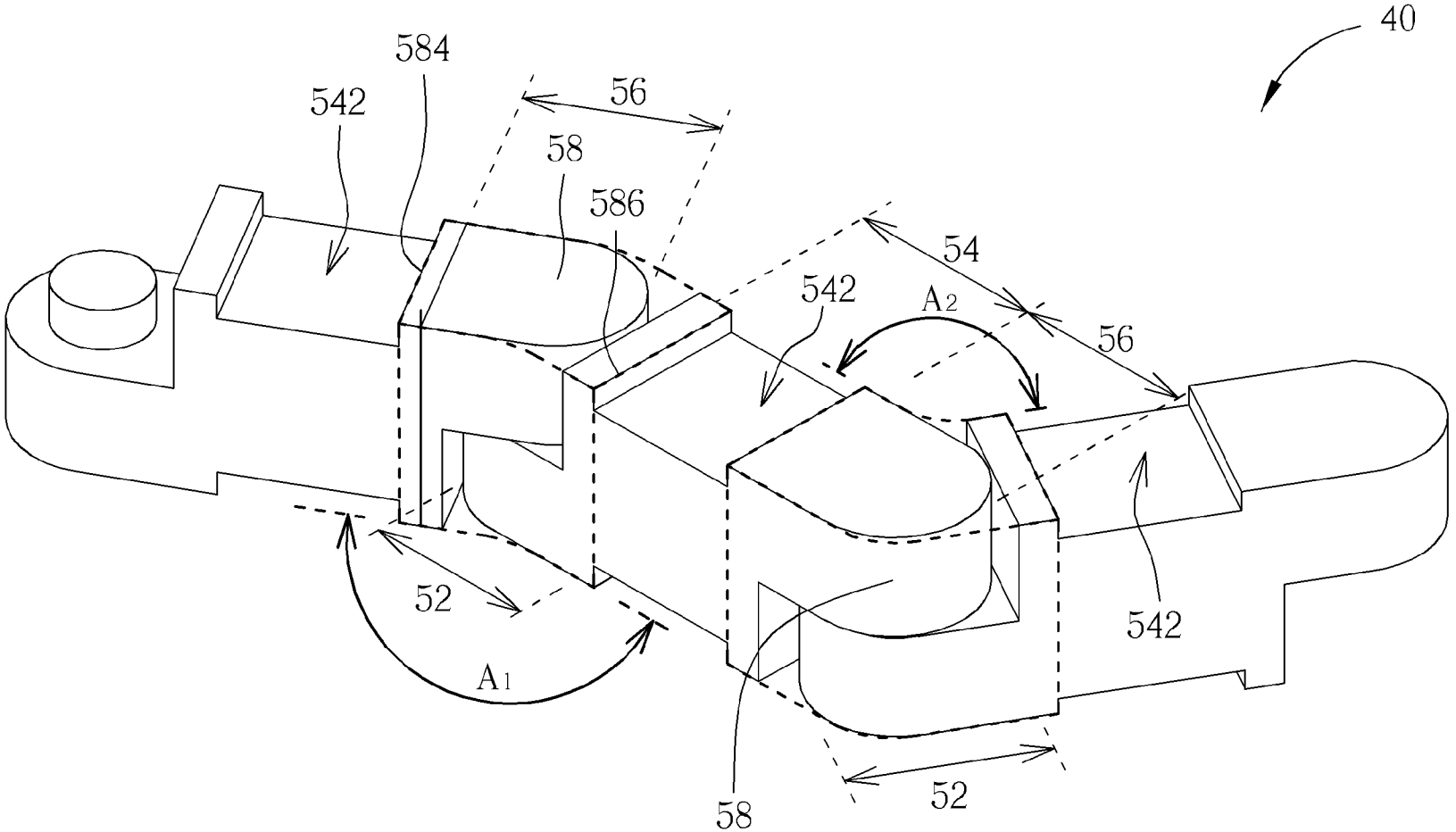
FIG. 5 is an illustration showing an embodiment of a first type of block set assembled from multiple first type of blocks in FIG. 4.

Please refer to FIG. 5. FIG. 5 is an illustration showing an embodiment of a first type of block set assembled from multiple first type of blocks in FIG. 4. In FIG. 5, the block set 40 includes three blocks 50 pivoted with one another, in a way as described previously. Since the right section 56 of each block 50 is pivoted to the left section 52 of the adjacent block 50, an included angle exists between each two adjacent blocks 50, or the included angle $A_1$ and $A_2$ in FIG. 5 as an example. Please refer to FIG. 4 together. The middle section 54 of each block 50 includes a top groove 542. A positioning section 58 is formed between the top groove 542 of one block 50 and the top groove 542 of the adjacent another block 50 and each positioning section 58 has corresponding contour according to the included angle $A_1$ (or $A_2$) between two adjacent blocks 50. It should be noted that each positioning section 58 contains at least parts of two blocks 50, e.g., the left section 52 of one block 50 and the right section 56 of another block 50, and the left boundary of each positioning section 58 reaches a side 584 of the top groove 542 of one block 50 and the right boundary of the positioning section 58 reaches a side 586 of the top groove 542 of another block 50. Hence, the boundary of each positioning section 58 contains at least one side 584 and one side 586 of two adjacent blocks 50 that respectively define the top grooves 542 of each own and part of the edges of the left section 52 and the right section 56 therebetween.

Figure 6A:
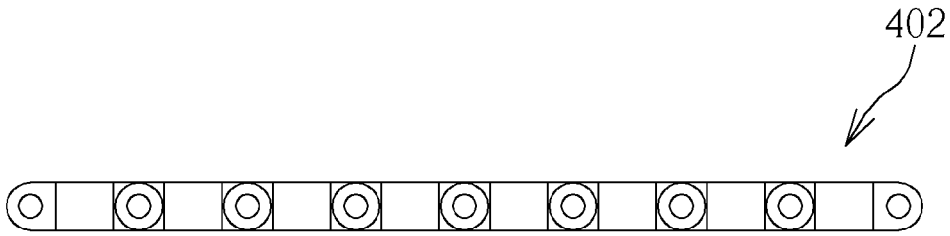
FIGS. 6A, 6B, 6C, 6D are illustrations of block sets with various shape assembled from the blocks according to the invention.
Figure 6B:
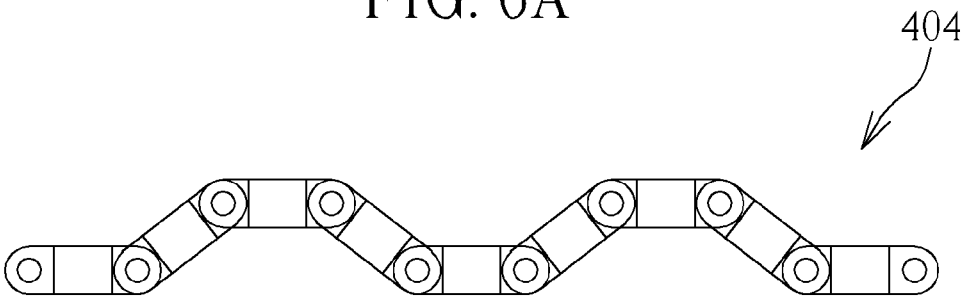
Figure 6C:
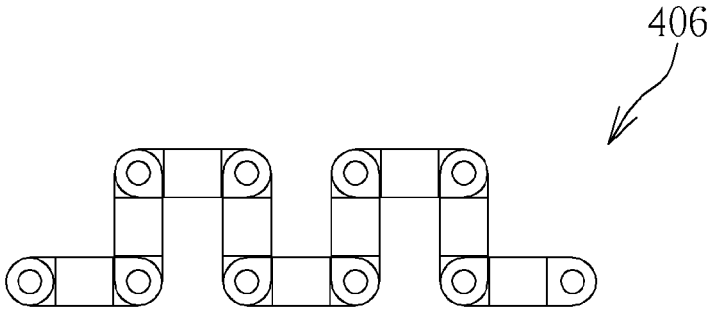
Figure 6D:
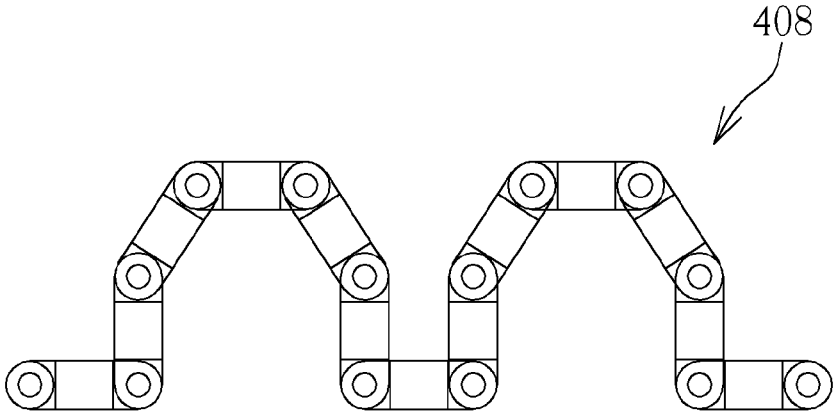

Please refer to FIG. 6A, 6B, 6C, 6D. FIG. 6A, 6B, 6C, 6D are illustrations of block sets with various shape assembled by the blocks according to the invention. Starting from the block 50 in FIG. 4 and FIG. 5, the cushion package structure of the invention may further include a plurality of blocks 50, which can be assembled to form one or multiple independent block sets, each having at least one block 50. In FIG. 6A, a block set 402 is composed by a plurality of blocks 50 transversely pivoted as a straight string. A block set 404 is formed to have longitudinal thickness as shown in FIG. 6B when the blocks 50 are pivoted to have an included angle. As the included angle between the blocks 50 turns to be 90 degree, a block set 406 with larger longitudinal thickness as shown in FIG. 6C is formed. To form a block set 408 with even larger longitudinal thickness, two or more blocks 50 may be aligned longitudinally as shown in FIG. 6D. By changing the included angles between the blocks 50, the invention provides block sets with different transverse lengths and longitudinal thicknesses, so as to define the storage room in the storage box. It should be noted that several embodiments of blocks and the block sets formed thereby are illustrated in FIG. 2A, 2B, 2C, 2D, and FIG. 6A, 6B, 6C, 6D in a simplified, overlook view. One can refer to FIG. 4, 5, and following figures for specific illustration of the blocks.

Figure 7:
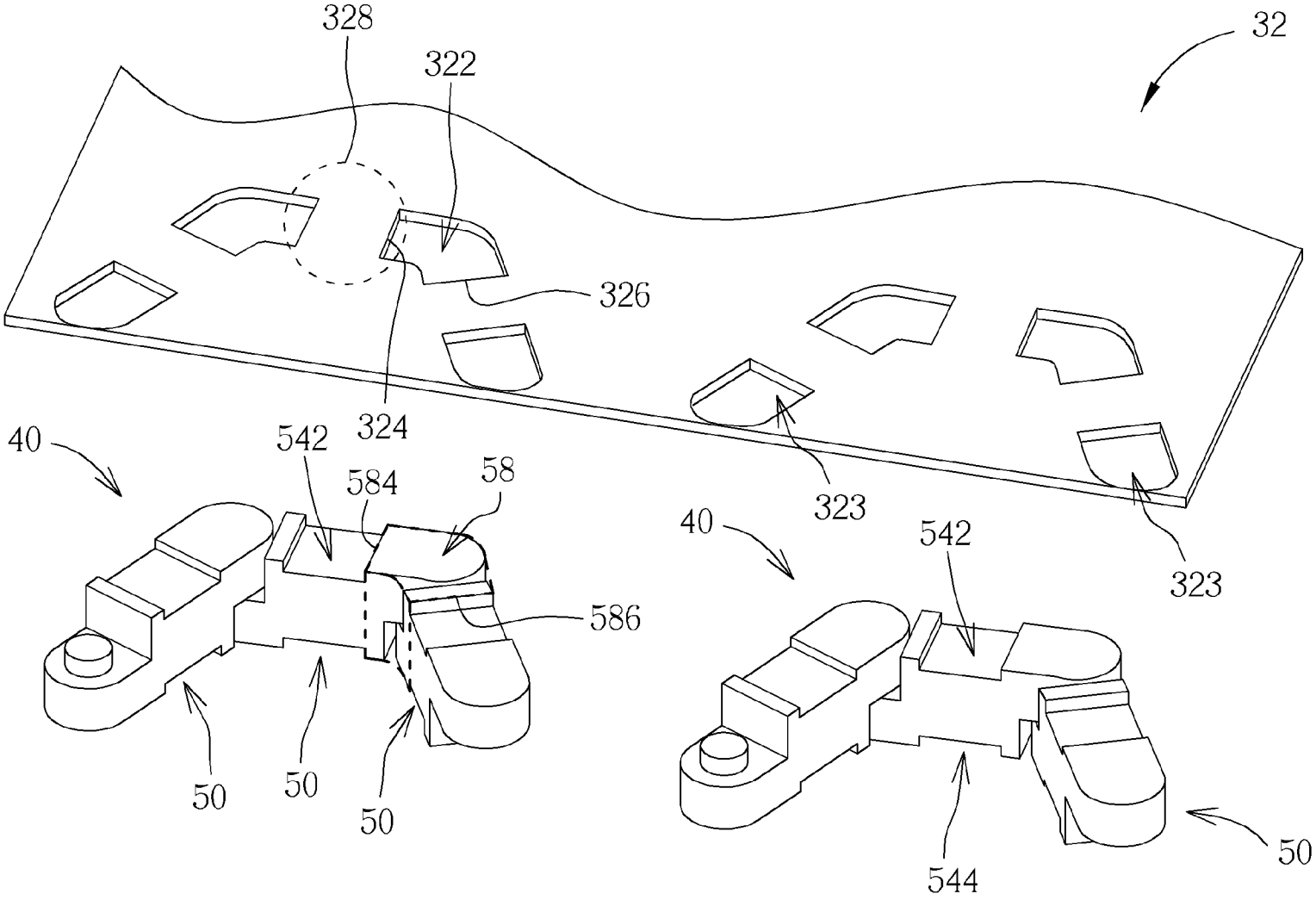
FIG. 7 is an illustration showing an embodiment of a second type of block set assembled from multiple first type of blocks and showing the top plate.

Please refer to FIG. 7. FIG. 7 is an illustration showing an embodiment of a second type of block set assembled from multiple first type of blocks and showing the top plate. As described, one or multiple blocks 50 (block sets 40) are disposed at the top plate 32 to define at least a boundary of the storage room, preferably forming the contour of the storage room. The top plate 32 includes at least a top positioning hole 322, a plurality of top positioning holes 322 in FIG. 7 for cooperating with the number of positioning sections 58 of the block sets 40. The positioning sections 58 formed between two adjacent blocks 50 of the block sets 40 are coupled with the corresponding top positioning holes 322, so that the blocks 50 (the block sets 40) may be coupled with the top plate 32. Each top positioning hole 322 has substantially the same contour as the corresponding positioning section 58. More specifically, as each positioning section 58 is coupled with the corresponding top positioning hole 322, the top positioning hole 322 surrounds the positioning section 58 and abuts against at least two sides of the positioning section 58. For example, a side 324 of the top positioning hole 322 abuts against the side 584 of the positioning section 58 and a side 326 of the top positioning hole 322 abuts against the side 586 of the positioning section 58. Additionally, two arcs between the side 324 and the side 326 of the top positioning hole 322 may also abut against part of the arcs between the side 584 and the side 586 of the positioning section 58. A section 328 of the top plate 32 falls between two adjacent top positioning holes 322 is coupled and fastened to the top groove 542 of the corresponding block 50.

Figure 8:
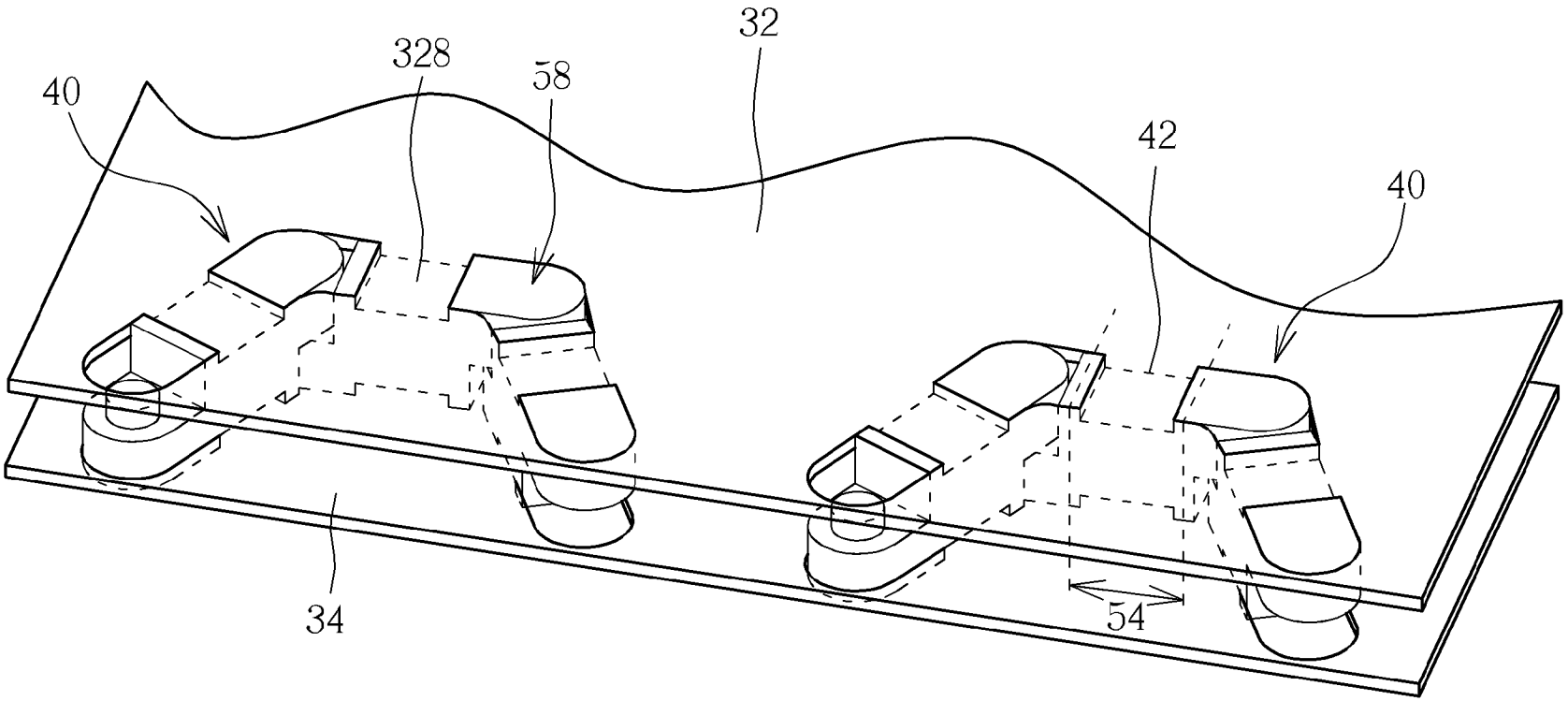
FIG. 8 is an illustration of the second type of block set in FIG. 7 coupled with the top plate and the bottom plate.

Please also refer to FIG. 8. FIG. 8 is an illustration of the second type of block set in FIG. 7 coupled with the top plate and the bottom plate. Besides the top groove 542, the middle section 54 of each block 50 has a bottom groove 544 at the side of the middle section 54 opposite to the top groove 542. Likewise, the positioning section 58 is formed between the bottom groove 544 of one block 50 and the bottom groove 544 of the adjacent another block 50. If the cushion package structure further uses the bottom plate 34, the positioning sections 58 of the block sets 40 also are coupled with the corresponding bottom positioning holes, which are visibly blocked by the block sets 40 in the figure, so that the blocks 50 may be coupled with the bottom plate 34. Specific structure detail of the bottom portion of the block sets 40 and the bottom plate 34 is similar to the top portion of the block sets 40 and the top plate 32, which is omitted here for brevity. It should be further noted that, for the embodiments in FIG. 7 and FIG. 8, part of the positioning holes such as the top end positioning hole 323 in FIG. 7 can also be adapted for accommodating positioning section formed by one block 50.

Figure 9:
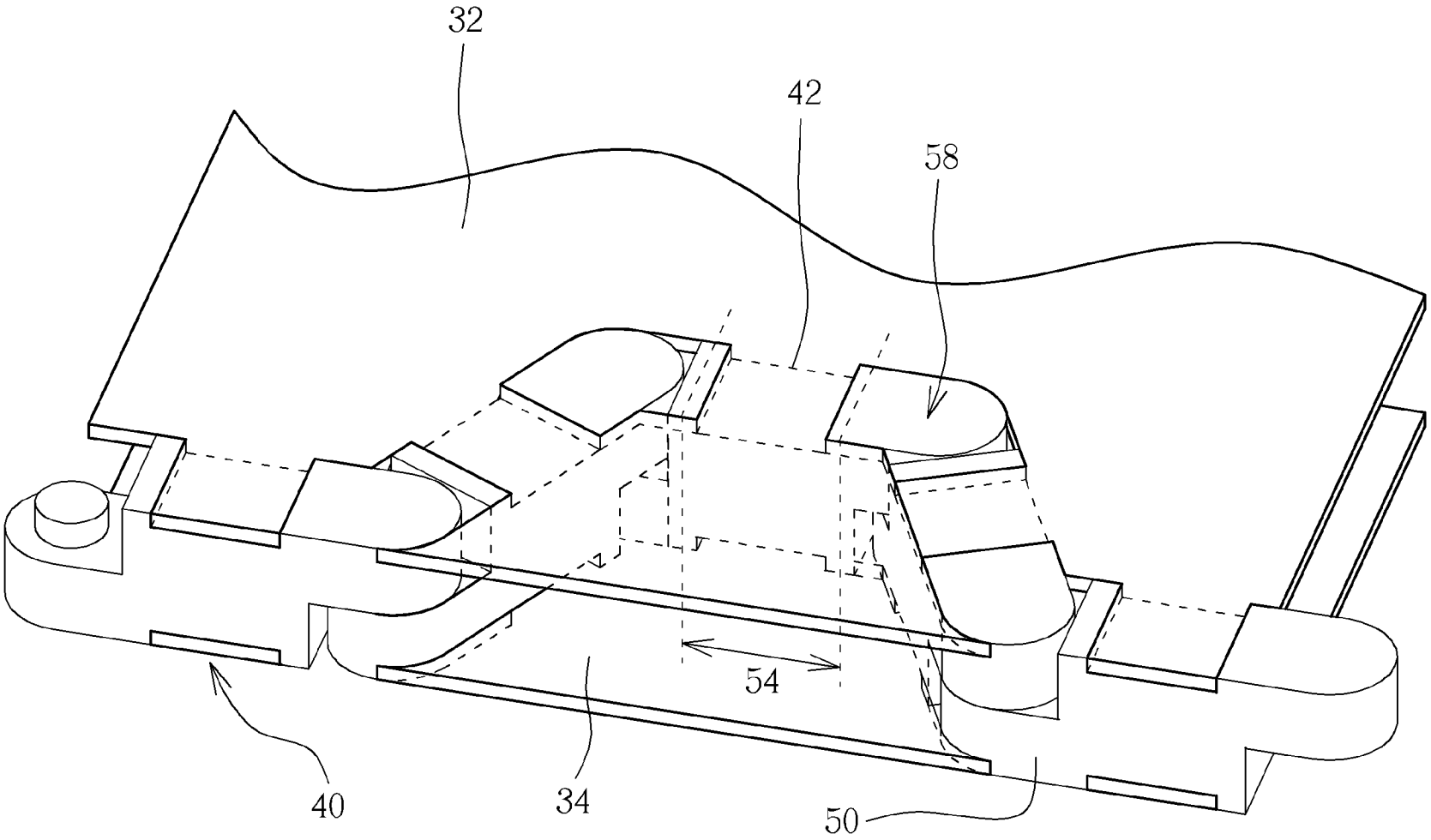
FIG. 9 is an illustration showing an embodiment of a third type of block set assembled from multiple first type of blocks and coupled with the top plate and the bottom plate.

Please refer to FIG. 9. FIG. 9 is an illustration showing an embodiment of a third type of block set assembled from multiple first type of blocks and coupled with the top plate and the bottom plate. While the embodiment in FIG. 8 has multiple independent block sets 40, another embodiment in FIG. 9 provides a block set 40 formed by a plurality of blocks 50 pivoted with one another. For both the embodiments in FIG. 8 and FIG. 9, at least three adjacent blocks 50 are pivoted to one another in a U shape, and the middle section 54 of the middle block 50 from the U shape provides the flat abutting plane 42 at another side opposite to the sidewall 16, as the block set 40 is disposed along the sidewall 16, referring FIG. 2, of the storage box gravitationally downward.

Figure 10:
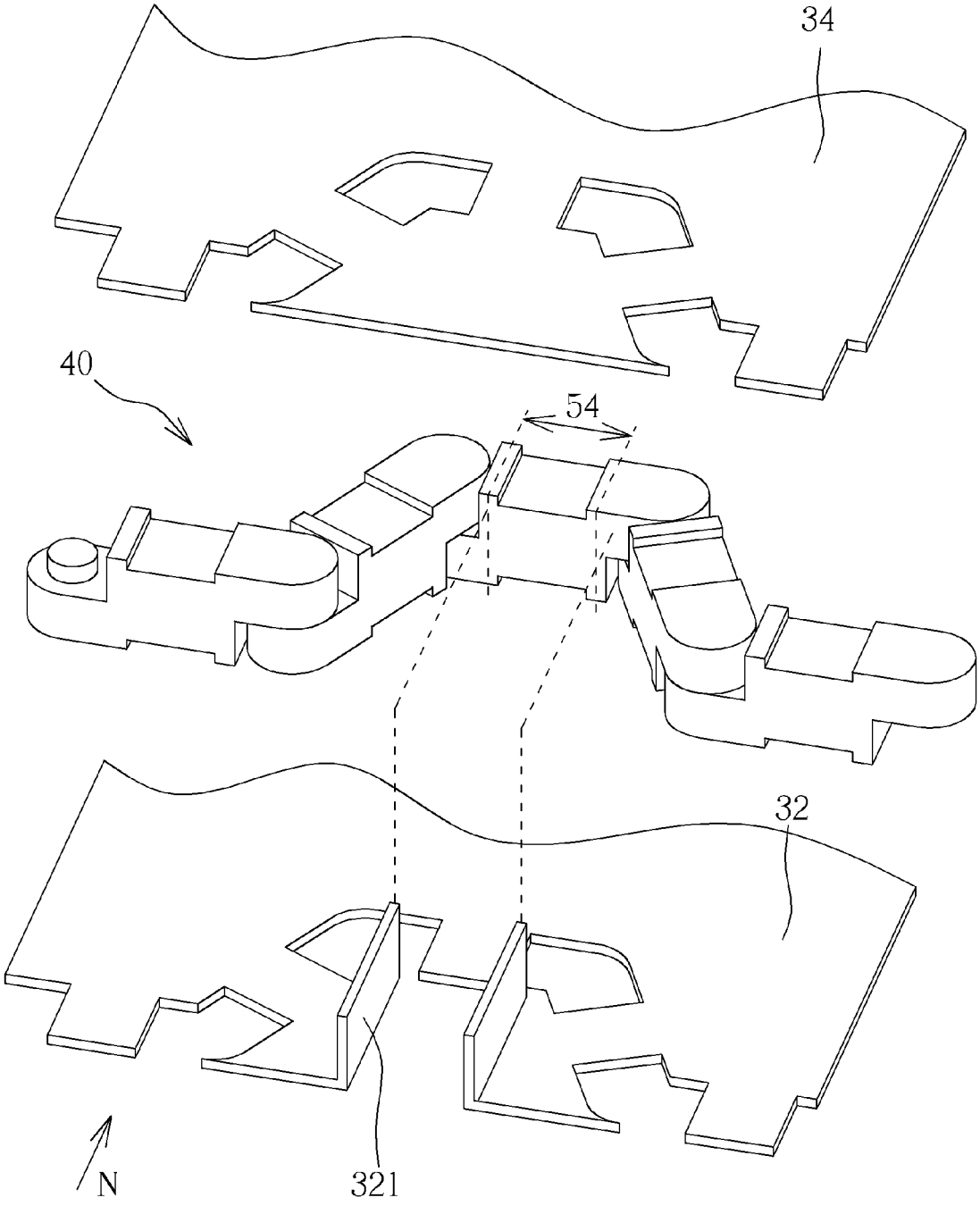
FIG. 10 is an illustration showing an embodiment of a fourth type of block set assembled from multiple first type of blocks and showing the top plate and the bottom plate.
Figure 11:
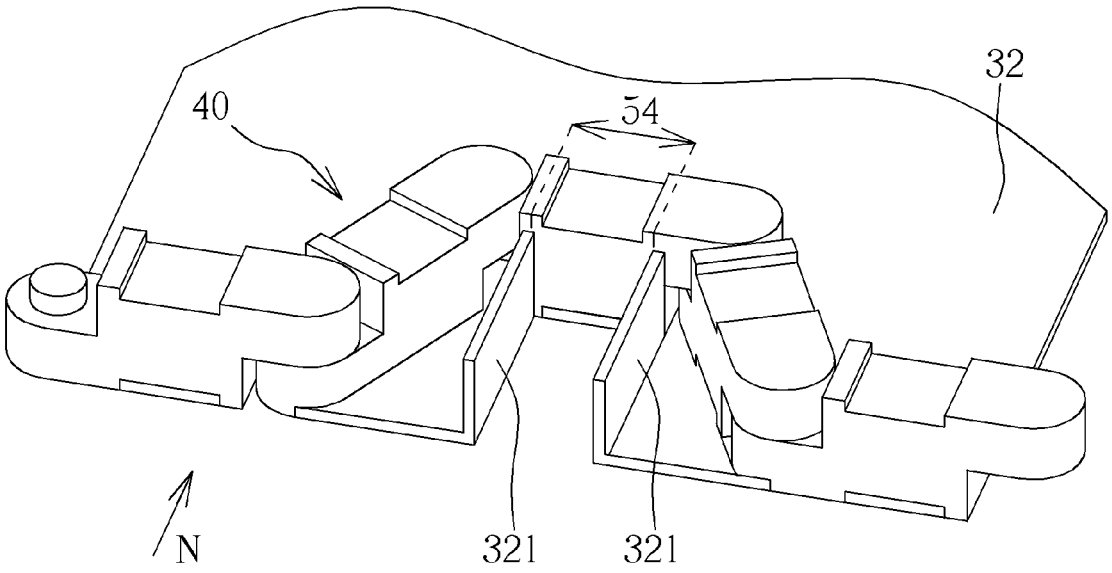
FIG. 11 is an illustration of the block set coupled with the top plate in FIG. 10.

Please refer to FIG. 10 and FIG. 11. FIG. 10 is an illustration showing an embodiment of a fourth type of block set assembled from multiple first type of blocks and showing the top plate and the bottom plate. FIG. 11 is an illustration of the block set coupled with the top plate in FIG. 10. In the embodiment in FIG. 10, the top plate 32 may further include a support part 321 formed by bending of the top plate 32 and configured adjacent to the middle section 54 of the middle block 50 of the U shape. As the block set 40 is coupled with the top plate 32 as shown in FIG. 11, the support part 321 may abut against the middle section 54 of the block 50 of the U shape gravitationally upward along direction N, providing further support for the block set 40.

Figure 12:
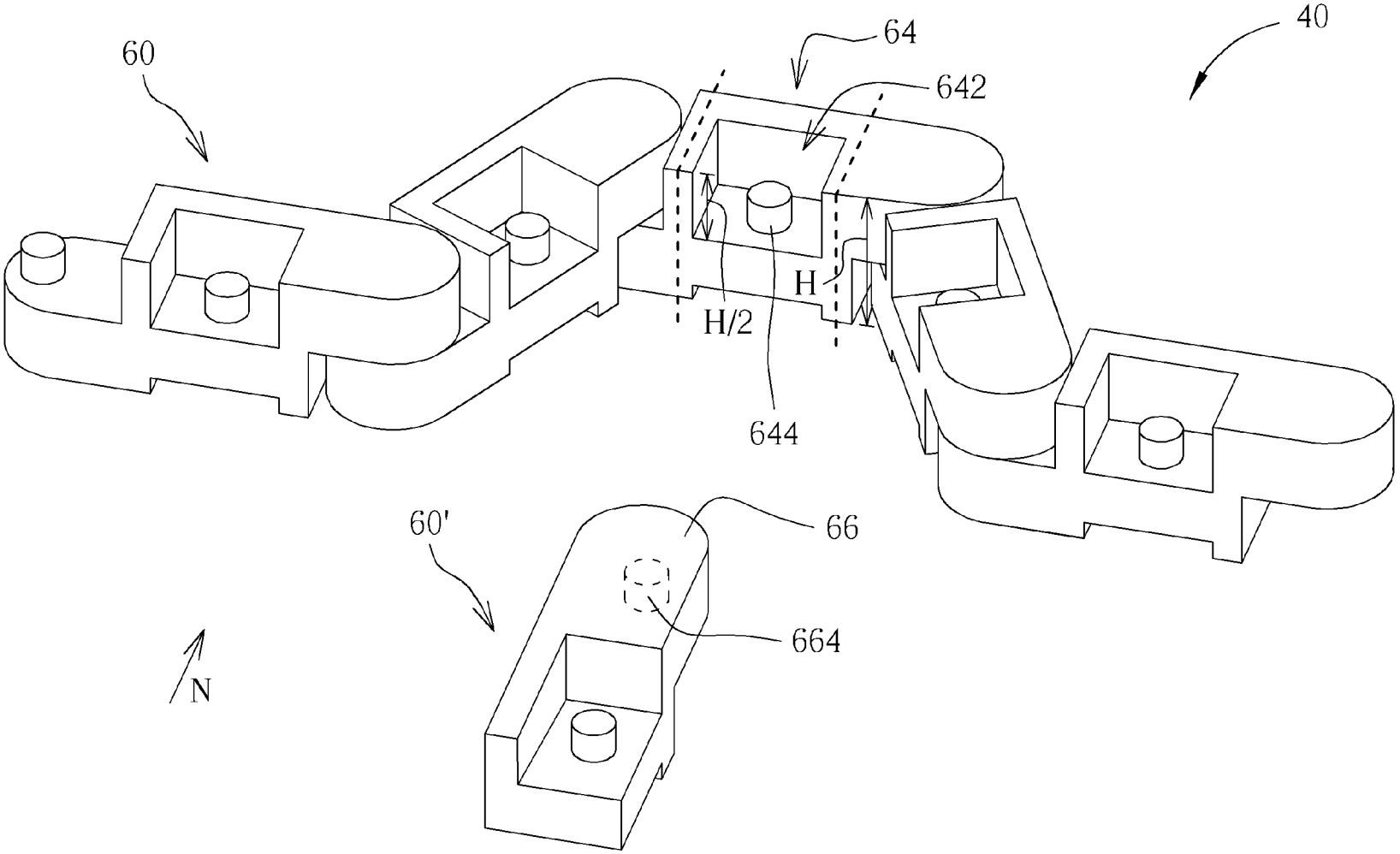
FIG. 12 is an illustration showing an embodiment of a plurality of second type of blocks according to the cushion package structure of the invention.
Figure 13:
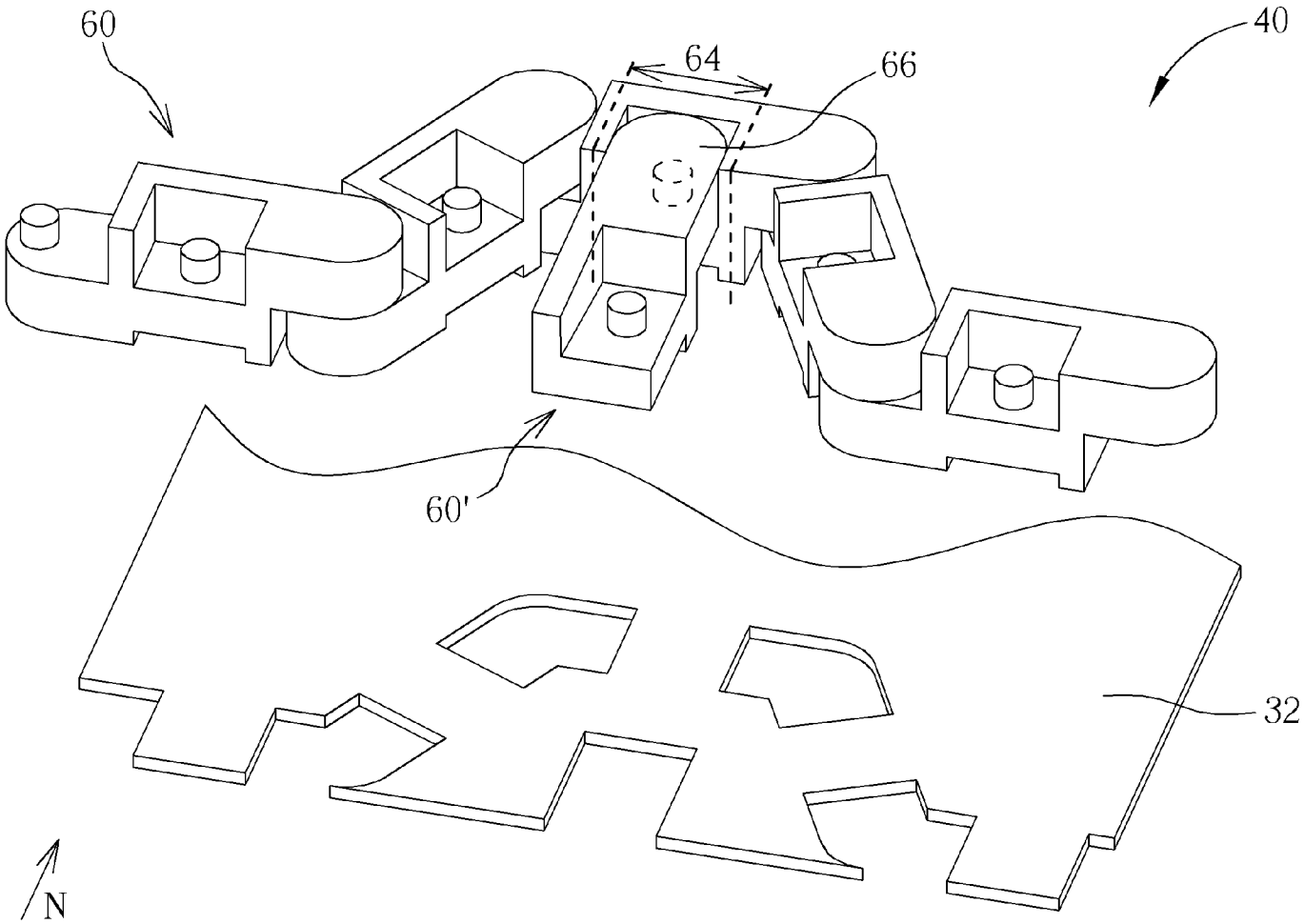
FIG. 13 is an illustration showing an embodiment of a fifth type of block set assembled from multiple second type of blocks and showing the top plate.

Besides the support part 321 for enhancement in FIG. 10 and FIG. 11, another embodiment of the invention further provides support structure that can enhance the support for the block set 40 along gravitationally upward direction. Please refer to FIG. 12 to FIG. 14. FIG. 12 is an illustration showing an embodiment of a plurality of second type of blocks according to the cushion package structure of the invention, FIG. 13 is an illustration showing an embodiment of a fifth type of block set assembled from multiple second type of blocks and showing the top plate, and FIG. 14 is an illustration showing an embodiment of a sixth type of block set assembled from multiple third type of blocks and showing the top plate.

For the embodiment in FIG. 12, the block set 40 includes at least three adjacent blocks 60 pivoted to one another in a U shape, whereas the fifth type of block set 40 may further utilize another block assembled at the middle for providing stronger support. The thickness of the middle section 64 of the middle block 60 that forms the top groove 642 is half the maximum thickness H of the middle section 64, i.e., H/2. The top groove 642 further includes a pin 644 capable of being coupled and pivoted to a pin hole 664 of the right section 66 of another block 60' as shown in FIG. 13 (the left section of the block 60' is removed so that the block 60' is accommodated in the inner space of the blocks 50 in U shape). In such way, when one end (the right section 66) of the block 60' is pivoted to the middle section 64 of the middle block 60, another end (partly removed) of the block 60' may abut against the sidewall, which is not shown, so that the block 60' provides a support for the block set 40 by abutting against the middle section 64 of the middle block 60 gravitationally upward along direction N.

Figure 14:
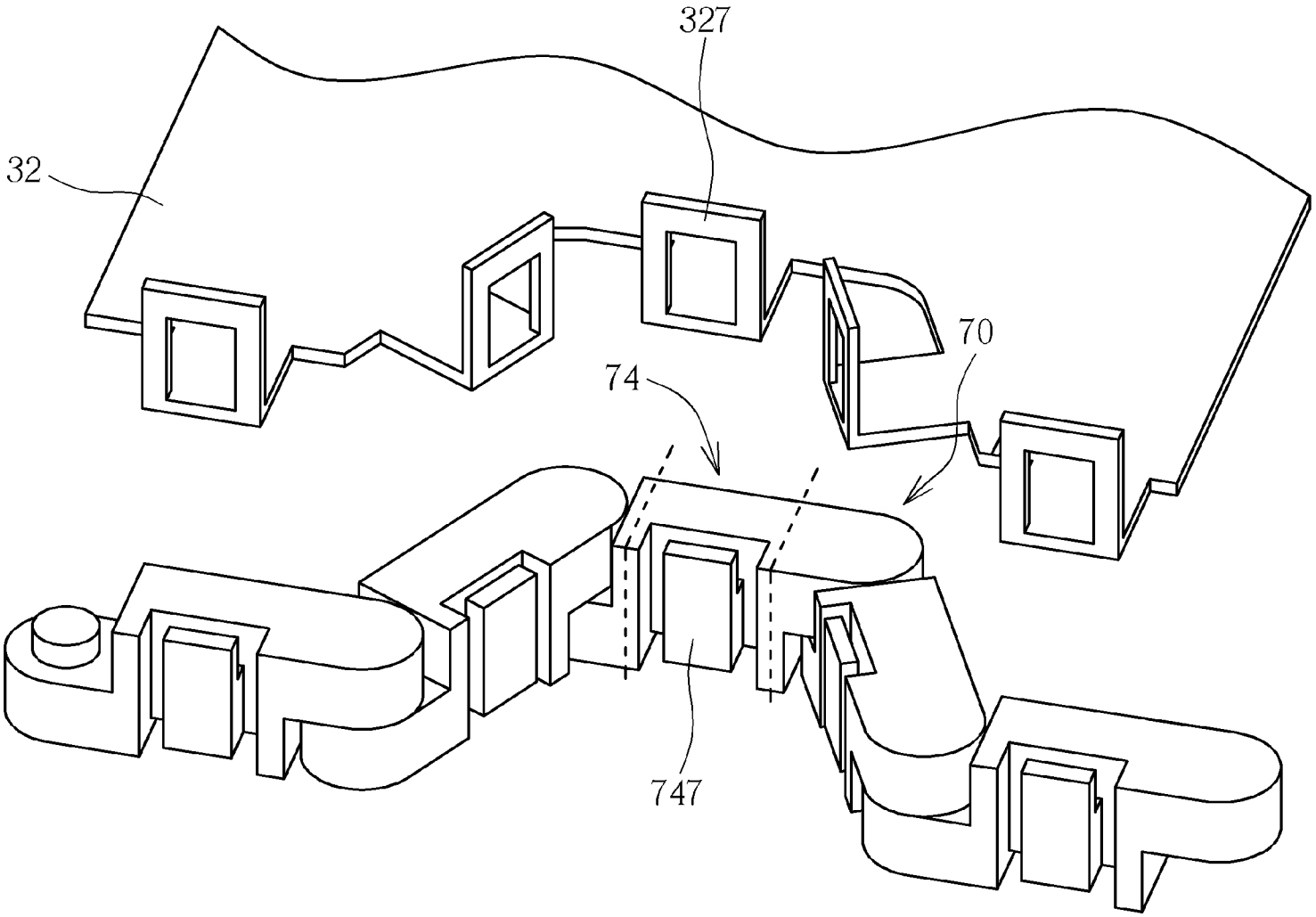
FIG. 14 is an illustration showing an embodiment of a sixth type of block set assembled from multiple third type of blocks and showing the top plate.

For the embodiment in FIG. 14, a plurality of blocks 70 forms the block set 40, where at least one block 70 has a hook 747 at its middle section 74 and the top plate 32 has a ring 327 at the position corresponding to the hook 747. The ring 327 may be formed by bending of the top plate 32. When the block set 40 is coupled with the top plate 32, the hook 747 is coupled with the ring 327, so that the block set 40 is more securely fastened at the top plate 32.

The embodiments of the invention provide a cushion package structure including at least a plate and two or more blocks. The plate is disposed within a storage box and the blocks are the same and pivotable with one another. As a number of blocks are connected with one another serially with various including angle between each adjacent two, one or multiple block sets may be formed thereby. Positioning holes on the plate having substantially same contour as corresponding positioning sections on the blocks are further prepared to engage with the positioning sections as the block sets are put to be disposed on the plate, thereby forming a storage space with a specific shape within the storage box. The cushion package structure comes with providing flexible room. Storage rooms with various contours and sizes can be provided via disposition of blocks in the containing room, through assembling different number of blocks and block sets and disposing them in the containing room of the storage box. The blocks may be removed from the plate, rearranged, and redisposed on another plate, so that a storage space with a different shape may be defined.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A storage box, comprising:

a first cover and a second cover;

a plurality of sidewalls defining and surrounding a containing room between the first cover and the second cover; and a cushion package structure, disposed within a storage box, wherein the cushion package structure is disposed in the containing room so as to provide a storage room in the storage box, and the cushion package structure comprises:

a top plate, comprising at least a top positioning hole, the top plate disposed at a top surface of the first cover, the top surface surrounded and defined by the plurality of sidewalls; and at least two blocks, each block comprising sequentially a left section, a middle section, and a right section adjacent to one another, the right section of one block pivoted to the left section of the adjacent another block, the middle section of each block comprising a top groove, a positioning section formed between the top groove of one block and the top groove of the adjacent another block, the positioning section coupled with the top positioning hole, so that the at least two blocks are coupled with the top plate;

wherein the at least two blocks are pivoted to each other and coupled with the top plate, one block having a flat abutting plane at a side, the flat abutting plane adjacent to at least a boundary of the storage room.

2. The storage box of claim 1, wherein the left section comprises a left pivot part having a pin and the right section comprises a right pivot part having a pin hole, the pin hole of the right section of one block coupled and pivoted to the pin of the left section of another block, so that the at least two blocks are pivotable with each other.

3. The storage box of claim 2, wherein a thickness of the left pivot part and the right pivot part along a coupling direction is half a maximum thickness of the middle section.

4. The storage box of claim 1, wherein the at least two blocks are pivoted to each other with an included angle therebetween, the positioning section having corresponding contour according to the included angle, the top positioning hole surrounding the positioning section and abutting against at least two sides of the positioning section.

5. The storage box of claim 4, wherein the at least two sides of the positioning section comprises the sides of the at least two blocks that define the top grooves.

6. The storage box of claim 1, wherein a part between two adjacent top positioning holes of the top plate is coupled and fastened to the top groove of at least one of the at least two blocks.

7. The storage box of claim 1, comprising a plurality of blocks pivoted to one another and disposed along at least a sidewall of the storage box.

8. The storage box of claim 7, wherein at least three adjacent blocks are pivoted to one another in a U shape, the middle section of the middle block providing the flat abutting plane at another side opposite to the sidewall.

9. The storage box of claim 8, wherein the top plate further comprises a support part formed by bending of the top plate, the support part adjacent to the middle section of the middle block and abutting against the middle section gravitationally upward.

10. The storage box of claim 8, wherein a thickness of the middle section of the middle block that forms the top groove is half a maximum thickness of the middle section, the top groove further comprising a pin coupled and pivoted to a pin hole of the right section of another block.

11. The storage box of claim 1, wherein the middle section of at least one block comprises a hook and the top plate comprises a ring corresponding to the hook, the ring formed by bending of the top plate and the ring coupling with the hook.

12. The storage box of claim 1, further comprising a bottom plate disposed at a bottom surface of the second cover, the bottom surface surrounded and defined by the plurality of sidewalls, the area and the shape of the bottom plate substantially the same as that of the bottom surface, the bottom plate comprising at least a bottom positioning hole.

13. The storage box of claim 12, wherein the middle section of each block comprises a bottom groove, the positioning section formed between the bottom groove of one block and the bottom groove of the adjacent another block, the positioning section coupled with the bottom positioning hole, so that the at least two blocks are coupled with the bottom plate.

14. A storage box, comprising:

a containing room; and a cushion package structure, disposed within a storage box, wherein the cushion package structure is disposed in the containing room, and the cushion package structure comprises:

a plate, disposed at a surface of the storage box, the plate comprising at least a positioning hole; and at least two blocks disposed at the plate, at least one of the blocks defining at least a boundary of a storage room on the plate, each block comprising sequentially a left section, a middle section, and a right section adjacent to one another, the right section of one block pivoted to the left section of the adjacent another block, the middle section of each block comprising a groove, a positioning section formed between the groove of one block and the groove of the adjacent another block after the at least two blocks pivoted to each other, the positioning section coupled with the positioning hole, so that the at least two blocks are coupled with the plate.

15. The storage box of claim 14, wherein the left section comprises a left pivot part having a pin and the right section comprises a right pivot part having a pin hole, the pin hole of the right section of one block coupled and pivoted to the pin of the left section of another block, so that the at least two blocks are pivotable with each other.

16. The storage box of claim 15, wherein a thickness of the left pivot part and the right pivot part along a coupling direction is half a maximum thickness of the middle section.

17. The storage box of claim 14, comprising a plurality of blocks pivoted to one another and defining the storage room in the containing room, each block made by cutting foam materials and formed monolithically and substantially the same with one another.

18. The storage box of claim 14, wherein the middle section of at least one block comprises a hook and the plate comprises a ring corresponding to the hook, the ring formed by bending of the top plate and the ring coupling with the hook.

* * * * *